United States Patent [19]

Blanchette

[11] 4,364,368

[45] Dec. 21, 1982

[54] EXHAUST GAS RECIRCULATION CONTROL ASSEMBLY

[75] Inventor: Jon A. Blanchette, Fairport, N.Y.

[73] Assignee: General Motors Corporation, Detroit, Mich.

[21] Appl. No.: 236,828

[22] Filed: Feb. 23, 1981

[51] Int. Cl.[3] ..... F02M 25/06

[52] U.S. Cl. ..... 123/568; 403/226; 403/DIG. 4; 403/297; 403/225; 403/227

[58] Field of Search ..... 123/568; 403/225, 226, 403/227, DIG. 4, 297

[56] References Cited

U.S. PATENT DOCUMENTS

| | | | |
|---|---|---|---|
| 2,943,875 | 7/1960 | Reichert | 403/226 |
| 4,186,702 | 2/1980 | Day et al. | 123/568 |
| 4,196,702 | 4/1980 | Bradshaw | 123/568 X |

*Primary Examiner*—Wendell E. Burns
*Attorney, Agent, or Firm*—C. K. Veenstra

[57] ABSTRACT

An exhaust gas recirculation valve pintle is secured on a hollow valve stem by a radially elastic retaining ring which allows the pintle to be withdrawn from the stem for removal of exhaust gas deposits.

2 Claims, 2 Drawing Figures

EXHAUST GAS RECIRCULATION CONTROL ASSEMBLY

TECHNICAL FIELD

This invention relates to control of exhaust gas recirculation and provides a novel assembly for controlling exhaust gas recirculation in proportion to induction air flow.

BACKGROUND

Recirculation of exhaust gases has been developed as a method for inhibiting formation of oxides of nitrogen during the combustion process in an internal combustion engine. In general, it is desired to recirculate exhaust gases at a rate proportional to the rate of engine induction air flow. To accomplish that purpose, exhaust gas recirculation (EGR) control assemblies have included an exhaust gas recirculation control valve pintle positioned to maintain the pressure in the EGR passage upstream of the pintle equal to a reference pressure. Recirculation of exhaust gas has thus been varied with exhaust backpressure, which in turn varies as a function of induction air flow, to provide exhaust gas recirculation substantially proportional to induction air flow.

In order to control the pressure in the EGR passage, many such EGR control assemblies have a hollow valve stem sensing the pressure in the EGR passage through openings in the valve pintle and communicating that pressure to a transducer. The transducer causes movement of the valve pintle to the position necessary to achieve the desired pressure in the EGR passage. In some such EGR control assemblies, however, exhaust gas deposits may form in the hollow valve stem, thus impairing the response of the transducer to changes in pressure in the EGR passage.

SUMMARY OF THE INVENTION

This invention provides an EGR control assembly of the foregoing nature but which is constructed to allow removal of exhaust gas deposits from the hollow valve stem so that the useful life of the EGR control assembly may be prolonged. With this invention, the valve pintle may be withdrawn from the valve stem to provide access to the interior of the valve stem for removal of exhaust gas deposits and then reassembled on the valve stem for continued use.

In the preferred embodiment of this invention shown in the drawing, the valve pintle is assembled to its valve stem with a radially elastic retaining ring which secures the pintle to the stem during operation but which may be stretched outwardly over the valve stem to allow removal of the pintle from the stem. This construction accordingly allows rapid servicing of the EGR control assembly to restore it to proper operation and prolong its useful life.

The details as well as other features and advantages of this invention are set forth in the remainder of the specification and are shown in the accompanying drawing.

BEST MODE FOR CARRYING OUT THE INVENTION

Figure 1:
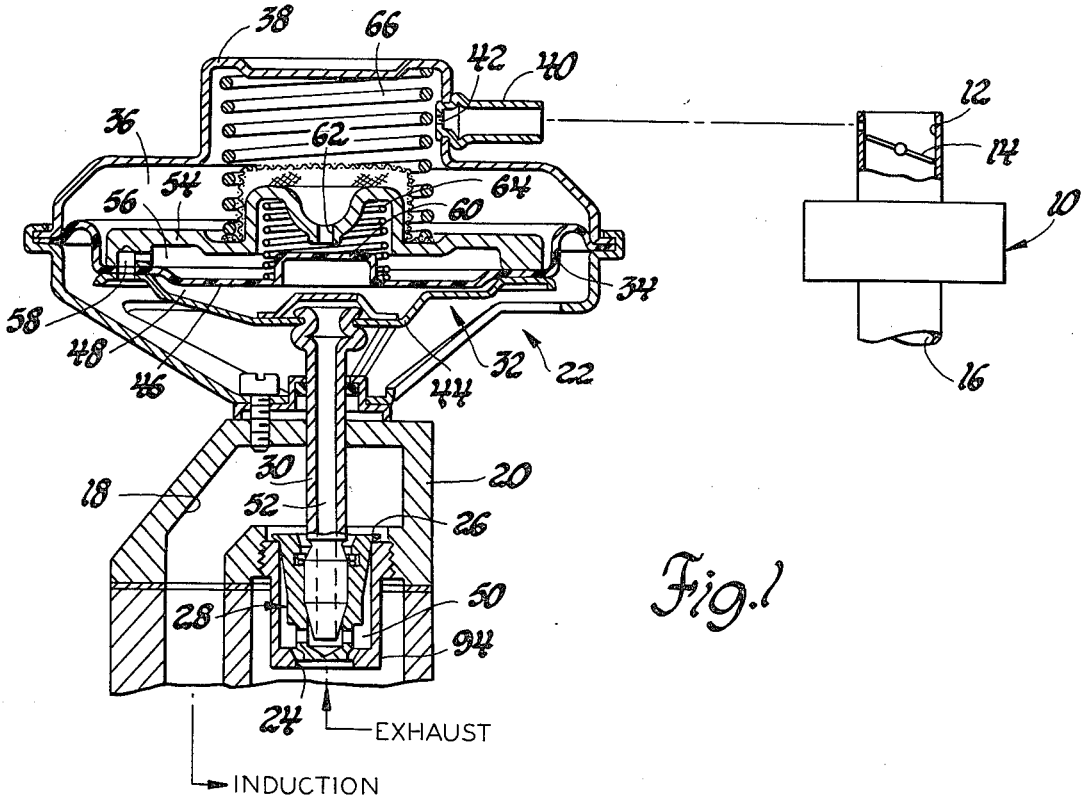
FIG. 1 is a sectional view of an EGR control assembly employing a preferred embodiment of this invention.

Referring first to FIG. 1, an internal combustion engine 10 has an air induction passage 12, a throttle 14 controlling induction air flow through passage 12, and an exhaust passage 16. An EGR passage 18 extends from exhaust passage 16 through the body 20 of an EGR control assembly 22 and then to induction passage 12 downstream of throttle 14.

An orifice 24 is disposed in EGR passage 18 upstream of a valve seat 26. A valve pintle 28 is associated with valve seat 26 and has a valve stem 30 secured to a transducer 32 which is carried on an annular operating diaphragm 34.

Operating diaphragm 34 forms a portion of an operating pressure chamber 36 which is closed by a cover 38. Cover 38 has a fitting 40 with an aperture 42 for sensing a subatmospheric pressure signal created in induction passage 12 adjacent throttle 14.

Transducer 32 includes a lower plate 44, and an inward extension of annular operating diaphragm 34 forms a control diaphragm 46 which cooperates with plate 44 to define a control pressure chamber 48. Control pressure chamber 48 senses the pressure in the zone 50 of EGR passage 18 between orifice 24 and valve seat 26 through the conduit 52 formed by hollow valve stem 30.

Transducer 32 also includes an upper plate 54 which cooperates with control diaphragm 46 to define an atmospheric pressure chamber 56. Chamber 56 has an inlet 58 for receiving air at atmospheric pressure.

Control diaphragm 46 carries a bleed valve 60 which controls air flow into operating pressure chamber 36 through a bleed 62 formed in upper plate 54.

During operation, an increase in pressure in zone 50 is sensed in control pressure chamber 48, and control diaphragm 46 lifts bleed valve 60 against the bias of a spring 64 to obstruct air flow through bleed 62. The operating pressure in chamber 36 is then reduced by the subatmospheric pressure signal sensed through aperture 42, and operating diaphragm 34 is raised against the bias of a spring 66 to lift valve pintle 28 from valve seat 26. The resulting increase in the exhaust gas recirculation area between valve pintle 28 and valve seat 26 provides increased exhaust gas recirculation, and the pressure in zone 50 decreases to balance the control pressure in chamer 48 with the reference pressure created by the bias of spring 64 and atmospheric pressure in chamber 56.

Upon a decrease in the pressure in zone 50, spring 64 and the atmospheric pressure in chamber 56 lower diaphragm 46, moving bleed valve 60 away from air bleed 62 to permit air flow through bleed 62 into chamber 36. The increased operating pressure in chamber 36 then allows spring 66 to lower operating diaphragm 34 and valve pintle 28. The resulting decrease in the exhaust gas recirculation area reduces exhaust gas recirculation, and the pressure in zone 50 increases to balance the control pressure in chamber 48 with the reference pressure.

EGR control assembly 22 thus positions its valve pintle 28 to produce an exhaust gas recirculation area which provides exhaust gas recirculation at rates establishing the pressure in zone 50 necessary to maintain the control pressure in chamber 48 equal to the reference pressure.

When the pressure in zone 50 equals the reference pressure, the flow of exhaust gases into zone 50 varies as a function of the exhaust backpressure in passage 16. Since the exhaust backpressure is a function of the flow through engine 10—that is, a function of the exhaust gas flow through passage 16 and thus the induction air flow through passage 12—exhaust gas recirculation through EGR passage 18 will be proportional to the induction air flow through passage 12.

From the foregoing it will be appreciated that as the pressure increases in zone 50, exhaust gases flow up through conduit 52 in valve stem 30 into control pressure chamber 48, and as the pressure decreases in zone 50, exhaust gases flow downwardly through conduit 52 from control pressure chamber 48. In some applications, exhaust gas deposits may form in conduit 52 and reduce the response of transducer 32 to changes in pressure in zone 50. With this invention, however, valve pintle 28 may be removed from valve stem 30 to facilitate removal of any exhaust gas deposits formed in conduit 52.

Figure 2:
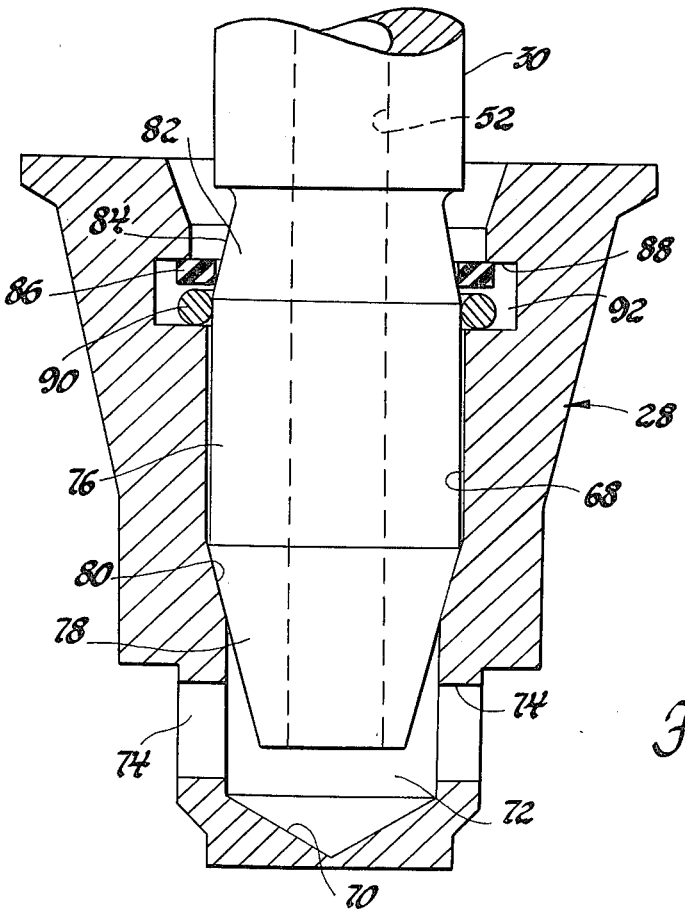
FIG. 2 is a view of a portion of the FIG. 1 embodiment enlarged to show the details of the pintle/stem assembly.

As shown in enlarged detail in FIG. 2, valve pintle 28 has an axially extending recess 68 terminating at the transversely extending lower end wall 70 and defining an internal chamber 72 adjacent end wall 70. Lateral openings 74 allow exhaust gases to enter chamber 72 from zone 50 of EGR passage 18.

The lower end 76 of valve stem 30 is received in recess 68 and has a conical tip 78 which seats against a conical ledge 80 formed in recess 68. The lower end 76 of valve stem 30 also has a portion 82 providing a reversely tapered outer surface 84 the diameter of which decreases with distance from the end wall 70 of valve pintle 28.

A radially elastic retaining ring 86 embraces tapered surface 84 and is seated against a radially inwardly extending shoulder 88 which is formed in recess 68 and faces the end wall 70 of valve pintle 28. Retaining ring 86 is thus effective to hold the conical tip 78 of valve stem 30 firmly in engagement with the conical ledge 80 formed in recess 68. A back-up ring 90 is disposed under retaining ring 86 to fill the void 92 created as shoulder 88 is formed.

Although retaining ring 86 holds the lower end 76 of valve stem 30 in recess 68, its radial elasticity allows reversely tapered surface 84 to stretch it outwardly and permit pintle 28 to be withdrawn from stem 30. Accordingly, should observation of EGR control assembly 22 detect impaired response of transducer 32 to changes in pressure in zone 50, EGR control assembly 22 may be removed from engine 10, the member 94 forming orifice 24 and valve seat 26 may be unscrewed from body 20, and valve pintle 28 may be withdrawn from valve stem 30, retaining ring 86 stretching radially outwardly over the lower end 76 of valve stem 30. Conduit 52 and chamber 72 are thus exposed to allow removal of exhaust gas deposits, and valve pintle 28 then may be reassembled on valve stem 30 for continued use. Reinstallation of member 94 and remounting of EGR control assembly 22 on engine 10 restore the EGR control system to proper operation.

The embodiments of the invention in which an exclusive property or privilege is claimed are defined as follows:

1. An assembly for controlling flow of exhaust gases through an exhaust gas recirculation passage, said assembly comprising a valve pintle adapted for disposition in said passage, said pintle having an axially extending recess terminating at a transversely extending end wall and defining an internal chamber adjacent said end wall, said pintle further having one or more lateral openings for allowing entry of exhaust gases from said passage to said chamber, said assembly further comprising a valve stem having a portion received in said recess, said valve stem being of hollow tubular form to define a conduit for conducting exhaust gases from said chamber to a pressure responsive member, wherein said recess has a ledge facing away from said end wall, wherein said valve stem portion has a tip received by said ledge, wherein said valve stem portion has a tapered outer surface the diameter of which decreases with distance from said end wall, wherein said recess has a shoulder facing toward said end wall and extending radially inwardly toward said tapered surface, and wherein a retaining ring embraces said tapered surface and abuts said shoulder to hold said tip firmly in engagement with said ledge and thereby retain said valve stem portion within said recess, said retaining ring being radially elastic to allow withdrawal of said pintle from said stem whereby exhaust gas deposits may be removed from said chamber and said conduit.

2. The assembly of claim 1 wherein said recess includes a lateral void adjacent said shoulder, and wherein said assembly further comprises a back-up ring occupying the portion of said void not occupied by said retaining ring.

* * * * *